United States Patent [19]

Lindblad

[11] 4,221,100

[45] Sep. 9, 1980

[54] METHOD FOR ERECTING AN EASILY ERECTABLE AND DISMOUNTABLE BUILDING

[75] Inventor: Leif Lindblad, Uddevalla, Sweden

[73] Assignee: Lief Lindblad Entreprenend AB, Uddevalla, Sweden

[21] Appl. No.: 942,863

[22] Filed: Sep. 15, 1978

Related U.S. Application Data

[62] Division of Ser. No. 795,546, May 10, 1977, abandoned.

[30] Foreign Application Priority Data

May 14, 1976 [SE] Sweden ..... 7605495

[51] Int. Cl.[2] ..... E04G 21/00; E04B 1/32

[52] U.S. Cl. ..... 52/748; 52/86

[58] Field of Search ..... 52/86, 748, 745, 549, 52/550, 640, 222

[56] References Cited

U.S. PATENT DOCUMENTS

| | | | |
|---|---|---|---|
| 1,032,284 | 7/1912 | Holland | 52/745 |
| 1,377,500 | 5/1921 | Nissen | 52/86 |
| 2,237,226 | 4/1941 | High | 52/86 |
| 2,328,197 | 8/1943 | Cowin | 52/86 |
| 2,604,194 | 7/1952 | Hammitt | 52/549 |
| 2,639,010 | 5/1953 | Weber | 52/549 |
| 2,793,720 | 5/1957 | Hawes | 52/640 |
| 2,830,334 | 4/1958 | Schroyer | 52/222 |
| 2,888,983 | 6/1959 | Toto | 52/222 |
| 2,988,810 | 6/1961 | Wilken | 52/222 |
| 3,057,119 | 10/1962 | Kessler | 52/86 |
| 3,080,022 | 3/1963 | Mote | 52/222 |
| 3,889,433 | 6/1975 | Enbank | 52/86 |

FOREIGN PATENT DOCUMENTS

| | | | |
|---|---|---|---|
| 1446398 | 6/1966 | France | 52/86 |

*Primary Examiner*—Price C. Faw, Jr.
*Assistant Examiner*—Henry E. Raduazo
*Attorney, Agent, or Firm*—Holman & Stern

[57] ABSTRACT

A method for easily erecting a building wherein the thin-walled sections are detachably fitted to frame by simple anchoring means, which can be manually brought to engagement with the frame when the sections are bent to the same curvature as that of the frame and which are secured to the frame by the resiliency of the sections when these are allowed to flex back to their initial curvature when the manual bending force is relieved.

6 Claims, 9 Drawing Figures

METHOD FOR ERECTING AN EASILY ERECTABLE AND DISMOUNTABLE BUILDING

This is a divisional of application Ser. No. 795,546, filed May 10,1977, and now abandoned.

BACKGROUND OF THE INVENTION

The present invention refers to an easily erectable and dismountable building of the type comprising a plurality of thin-walled sections, which are anchored to an underlying supporting frame by aid of anchoring means arranged to extend through apertures in said sections.

The invention is a method for mounting such a building.

The intended building is primarily adapted for temporary use, and appropriate fields of application can be as warehouses, workshops hangars and the like.

In earlier constructions of this type the anchoring means have been designed e.g. as hook members which could be tightened by aid of screw joints and the like. This older mode of construction has given a rather satisfactory result, but the time required for fitting and tightening the plurality of screws or bolts required for a building of ordinary size will be rather long and this means that the working costs for erecting such a building will be comparatively large. This older method of erection will also involve the risk that fretting corrosion will form between the surfaces of bolts and nuts, which will make a desired dismounting of the building difficult if and when removal of the building is desired. This drawback can make it necessary to cut off the anchoring members by aid of a welding torch or the like, which in turn will cause large risks of damaging the sections forming part of the building during the dismounting operation.

Buildings of this type are oftenly built in hangar-form i.e. the cross-section of the building is substantially semicircular. At earlier constructions of such hangar-shaped buildings from such thin-walled sections have these sections prior to mounting been given a permanent deformation to an arch-form corresponding to the form of the erected building and the sections have thereupon been mounted e.g. by aid of the adjustable anchoring members described hereabove. This means a further drawback in that the handling and transport of the bent sections will be considerably more complicated than the handling and transport of plane sections.

In U.S. Pat. 2 328 197 has been described a building structure of the kind specified in this application. The elements of this older building corresponding to the sections as hereinbefore described are bent to assume the curvature of the frame prior to being fitted thereto, but the fitting to the frame thereupon is made by means of screw or bolt joints. The resiliency of the sections is therefore not used in the manner now proposed by this application and the time necessary for fitting and tightening all the required joints will be quite long.

SUMMARY OF THE INVENTION

The purpose of the invention is to a method of erecting a building of the type specified, which is very easy to mount and dismount, and which will therefore become cheap as to mounting and dismounting costs. This is achieved thereby that each section when mounted is biased and adapted to retain the anchoring member in engagement with the supporting frame by aid of its resiliency.

The method of erecting a building of the above-identified type is characterized thereby that a first thin-walled section, provided with apertures near each one of its corners, is provided with anchoring members extending through said apertures, that the anchoring members at one side edge of said section is governed manually to engagement with a transverse struts in a supporting frame, provided with a plurality of such transverse struts which are arranged on frame portions extending in a direction differing from that of the sections in their initial, unmounted condition, that the section is bent manually against the action of its resiliency in such a manner that the anchoring members at the opposite side edge of the section by manual guidance are brought to a position in which they engage a second transverse strut arranged in parallel with said first strut, in such a manner that engagement is achieved when the manually exerted force is relieved and the section is allowed to flex against its initial extension, and that further thin-walled sections are mounted in the same manner as said first section, each further section thereby being inserted with its first end below the edge of the section mounted immediately thereabove, in such manner that overlapping is achieved at the anchoring, the apertures of the front end of said further sections thereby being provided with slots opening at the front end of the section, whereby the anchoring members mounted in the apertures at the rear end of the adjacent, mounted section will enter through said slots into said front apertures of the further section during the mounting of this, and thereupon act as the frontal anchoring members of this further section.

DESCRIPTION OF THE PREFERRED EMBODIMENTS

Figure 1:
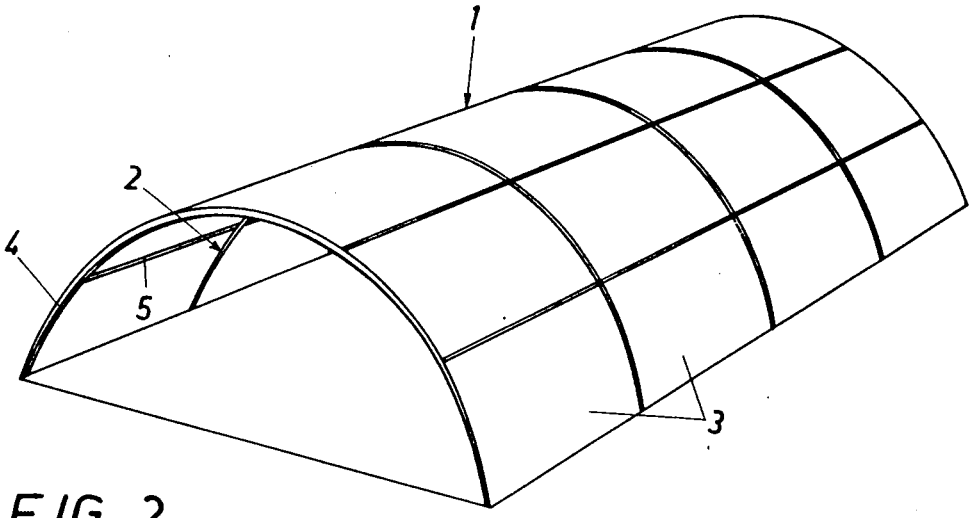
FIG. 1 shows in a perspective projection a hangar shaped building of the kind intended in the application.

In FIG. 1 is shown a hangar-shaped building 1, which comprises a supporting frame 2 and a number of thin-walled sections 3 mounted thereon and preferably consisting of sheet metal but which sections also can be e.g. sheets of plastic material. The supporting frame incorporates in the embodiment shown a number of arch-formed members 4, and a number of transverse struts 5, 6 fitted to said arch-formed members and connecting these. The sections 3 are, as can be better seen from FIG. 2, mounted to the supporting frame by aid of specific anchoring members 7, which extend through apertures arranged near each one of the four corners of the section, and are adapted when mounted to engage with a connecting piece 8 the struts 6 of the supporting frame and thereby retain the section in position relative to said supporting frame. The figure shows how a first section has been mounted to the supporting frame, whereby the connecting pieces 8 of the anchoring members 7 have been hooked around two struts 6. It is further shown how a second section 3' just is mounted. The frontal apertures as seen in the direction of mounting in this second section have been provided with slots which extend to the frontal edge of the section. The frontal edge of this second section 3' can therefore be pushed in below the rear edge of the previously mounted section 3, the slots thereby guiding the section 3' in relation to the earlier affixed anchoring members 7, until these are situated in the apertures at the front edge of this second section 3'. At the rear edge of the second section 3' there are round apertures similar to those of the said first section 3, and these rear apertures are also fitted with anchoring members 7. As shown in FIG. 3 the section 3' during mounting will be pushed manually in the direction shown by arrow A against the supporting frame to the position shown in dash lines, and when the connecting piece 8 of the anchoring member shall snap behind the transverse strut 6 the connecting piece can be governed in the longitudinal direction of the section by manual operation from the outside of the section by means of the governing member 9 which projects upwards and can be moved along a curved path intimated with arrow B. By using a section 3, 3' such as shown which in its normal, uninfluenced condition has a curvature which differs from the curvature of the supporting frame, i.e. in the embodiment shown where the supporting frame has an arch-formed curvature is the section preferably quite straight, it is possible during mounting of the section to bias this in such a manner that its self resiliency strives to pull to the anchoring member away from the transverse strut 6, which is rendered impossible by the connecting piece 8 which is hooked around said strut. In the embodiment shown is used an arch-formed supporting frame and initially straight sections but it is of course also possible to have a straight or plane supporting frame on which is mounted initially curved sections which are pressed to engagement with the plane supporting frame. At such a design is however the advantage of an easier handling and transport as compared to sections having the same curvature as the supporting frame lost. FIG. 3 shows in a larger scale an endview of a section 3, which in the embodiment shown is corrugated. Such corrugation is however not necessary, but the section can instead be quite smooth or have another cross-section without thereby changing the function and advantages of the invention. An advantage with corrugated sections is however that it is possible to let the throughs and the crests of the wave-pattern of the corrugations on previously mounted sections act as guides for the sections which shall be mounted thereafter. This guiding possibility can be utilized both longitudinally and laterally, and it is hereby possible to guide the sections during mounting with more accuracy to correct mounting positions without the operator thereby being particularly observant or careful. As can be seen from FIG. 3 is the anchoring member 7 composed of an elongated governing member 9 situated on the outer side of the section and hook-formed connecting pieces 8 situated on the inner side of the section. The shanks of these connecting pieces 8 extend through the above mentioned apertures, which either are round or provided with open slots 10 extending to the front edge of the section, such as shown in the right hand part of the figure.

Figure 4:
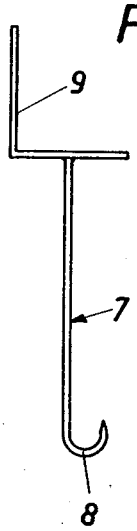
FIG.4 shows a side elevation of the anchoring member shown in FIG. 3.
Figure 5:
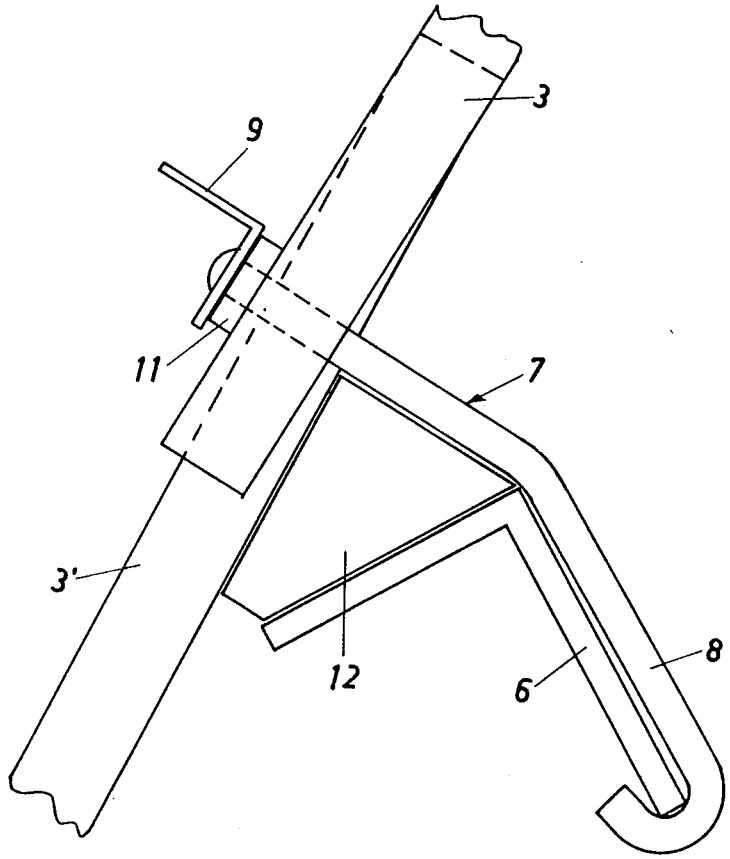
FIG. 5 shows a portion of a modified embodiment of the anchoring member in a position where it is mounted to a strut of the supporting frame.

FIG. 4 shows in a side elevation more in detail the design of the anchoring member and as can be seen in this figure the governing member 9 is an angle bar. The shape and the appearance of the anchoring member can of course be modified without thereby changing the basic inventive idea, and FIG. 5 shows an example of a modified embodiment of the anchoring member, in which the governing member 9 is fixed by bolts to the connecting piece 8 proper, which furthermore has a bend which is not present in the embodiment according to FIG. 4. In this figure is furthermore shown a first section 3 and second section 3' in mounted positions, where the front edge of the second section 3' has been pushed in below the rear portion of the said first section. In order to avoid leakage of water through the apertures in the section it is possible such as shown in the figure, to provide the upper shank-portion of the anchoring member with a seal 11, which engages the outer side surface of the section and is pressed against this by means of the biasing force in the biased section. It is further shown in this figure how a locking member 12 designed as a triangular batten has been pushed in between the under side of the mounted section 3' and a portion of the transverse strut 6. This locking member will efficiently prevent external forces, e.g. gusts of wind and the like from unintended influence upon the sections such that their anchoring members will loose their engagement with the struts 6.

Figure 2:
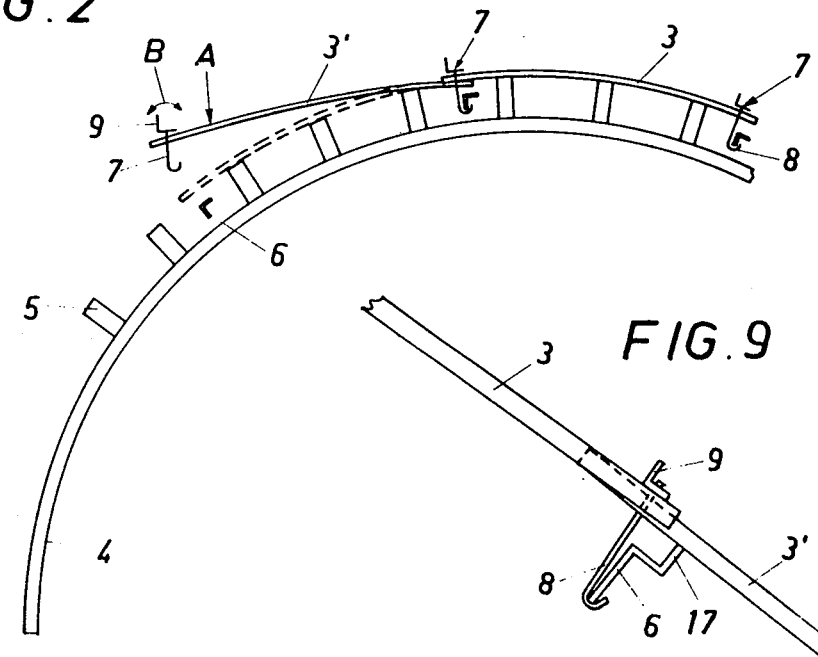
FIG. 2 is a part view of an arch-formed portion forming part of the supporting frame of the building, and shown with a section mounted and a second section during mounting.
Figure 3:
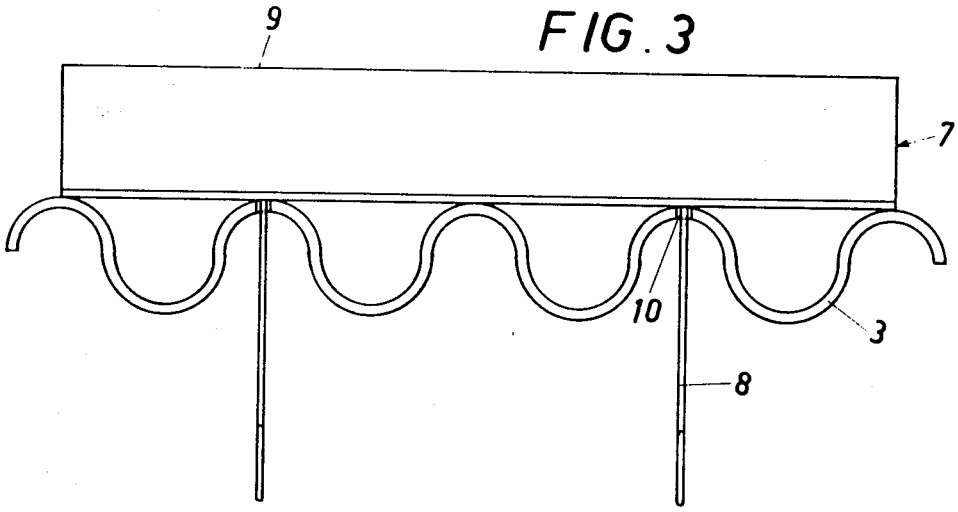
FIG. 3 is a view in the longitudinal direction of the section, showing a section and the associated anchoring member.

By means of this construction will the sections of the building be easily removeable, as soon as the locking member 12 has been removed, as it is only required that the free edge of a section is pressed against the supporting frame and that it is ascertained that the anchoring members takes part in this motion, whereupon the connecting pieces 8 by aid of the governing member 9 are brought away from the transverse strut 6, whereupon the force upon the section is relieved to let the section flex to the position of section 3' shown in FIG. 2 in continuous lines. The front edge of the section can thereupon easily be pulled out from under the rear edge of the section mounted nearest above, and this procedure can thereupon be repeated with the next section and so on. With such a mode of dismounting is the risk for damages on the components forming part of the building very remote.

Figure 9:
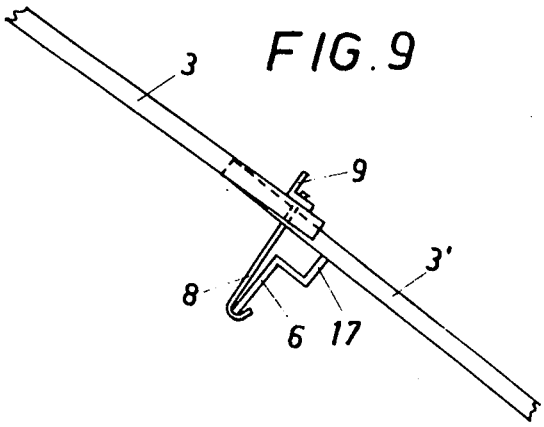
FIG. 9 shows in a fragmentary side elevation a modified embodiment of the transverse strut of the supporting frame with sections mounted thereon.

In FIG. 9 is shown another embodiment adapted to prevent the sections from unintentionally being disconnected from the supporting frame, e.g. by wind pressure or the like. In this embodiment the transverse strut 6 is proper provided with a further supporting flange 17, projecting against the sections 3, 3' and adapted to be situated close to the front edge portion of a section 3' when this has been biased to its mounting position. As the supporting flange 17 does not hamper the movement of the rear end of the section 3, as soon as the front end of the second section 3' has been removed from under the rear edge of the first section 3, is it evident that such an additional flange 17 on the transverse strut 6 will efficiently substitute the triangular batten 12 shown in FIG. 5. The arrangement of an additional flange 17 which is integral with the strut will also mean that an automatic locking of the sections will be achieved upon mounting without the extra work of fitting in locking members in the form of battens or the like between the section and the strut.

Figure 6:
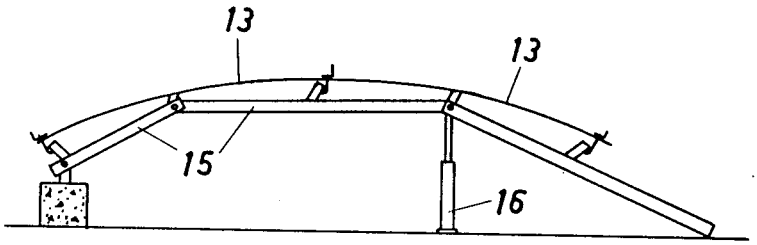
FIGS. 6 to 8 show schematically a preferred method of mounting and erecting a building according to the invention.
Figure 7:
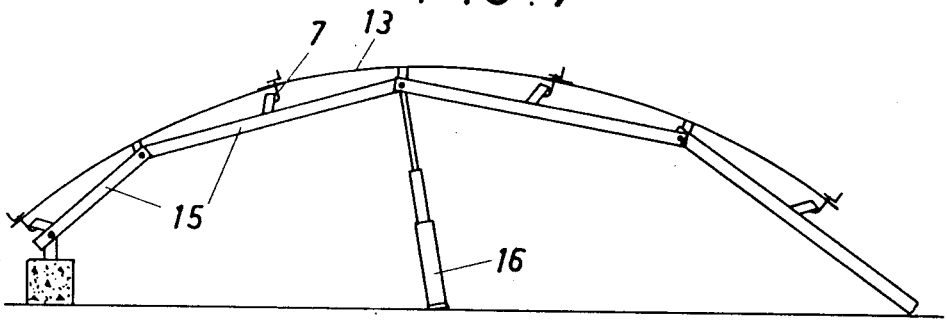
Figure 8:
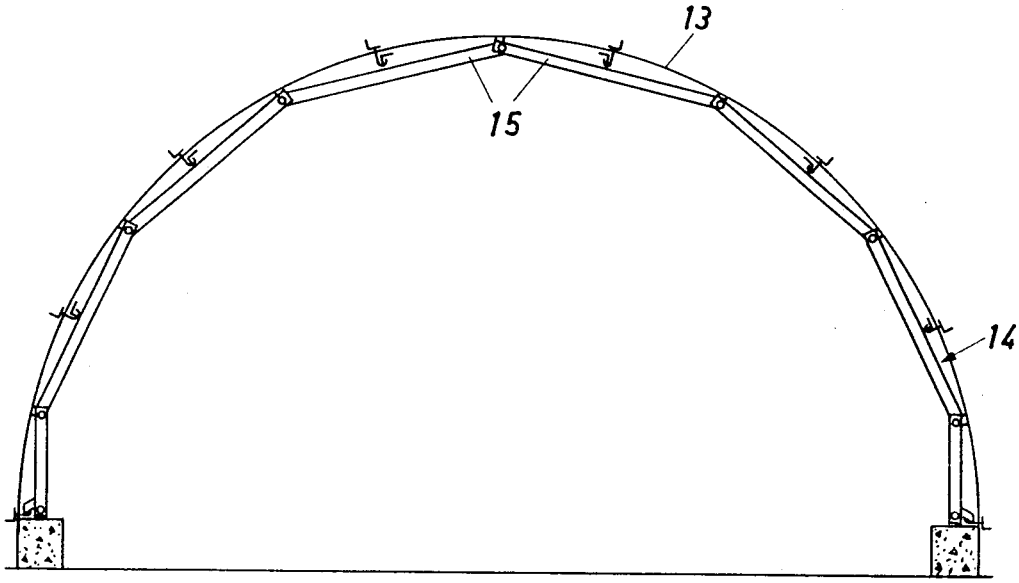

In FIGS. 6 to 8 is shown in three schematic side elevations how an arch-formed portion 14, forming part of the building, is composed by several separate members 15, on which sections 13 are mounted in the manner described in connection to FIG. 2, by means of anchoring members of the type specified in the foregoing. At the erection illustrated in the three figures is preferably used hydraulic jacks 16, or similar devices by means of which the construction is raised step by step as the members 15 are affixed to the arch 14. The sections 13 are hereby mounted at the same pace as the arch members 15, and the members 15 which are detachably connected to each other e.g. by means of bolt joints, will form a complete arch as shown in FIG. 8, and the end of which can be bolted to concrete foundations bases on the ground. Mounting with aid of hydraulic jacks is known in the art, but it involves a particular advantage in connection with the erection of a building of the kind described in this application as the stress in the sections 13 can be allowed to vary, whereby the curvature of the arch is not settled by the form of the sections and the radius of curvature of the building can therefore be altered to meet different requirements or wishes.

The invention is not limited to the embodiments shown in the drawings and described in connection thereto, but modifications are possible within the scope of the inventive idea. The basic feature of the invention can thus, as mentioned above, be utilized with good result also at supporting frames having straight sides, in which case the sections to be used should be bent in one way or another to produce the required biasing force when they are adapted to the form of the supporting frame.

What I claim is:

1. A method for erecting a building comprising arch-form members, parallel transverse frame members connected to said arch-form members, thin-walled sections overlapping each other over said transverse frame members and said arch-form members, and anchoring members anchoring said sections to said transverse frame members, each said section having an initial curvature, corners, a frontal edge, and a rear edge; comprising the steps of:

(a) providing each said sections with apertures near each of its corners, the apertures near the frontal edge being slots extending to the frontal edge;

(b) anchoring one edge of a first section to a first transverse frame member by engaging anchoring members through said apertures to said first transverse frame member;

(c) anchoring another edge of said first section to a second transverse frame member by manually bending it against the action of its inherent resiliency, engaging further anchoring members through apertures to said second transverse frame member, and relieving the manual bending force allowing said first section to flex back against its initial curvature thereby anchoring said first section to said frame member solely by the biasing of said first section;

(d) sliding the frontal edge of a further section under an anchored edge of a previous section engaging said slots with already engaged anchoring members of said previous section thereby overlapping said previous section over said further section;

(e) anchoring the rear edge of said further section by manually bending it against the action of its inherent resiliency, engaging further anchoring members through the rear apertures to a further transverse frame member, and relieving the manual bending force allowing said further section to flex back against its initial curvature thereby anchoring said further section to said frame members solely by the biasing of said further section; and (f) repeating steps d and e.

2. The method as claimed in claim 1, further comprising performing the following steps concurrently with steps d, e, and f:

fabricating said arch-form members as detachably interconnectable separate members;

sequentially attaching transverse frame members to adjacent separate members while said separate members are being interconnected to form said arch-form members; and sequentially raising said arch-form members with transverse frame members and anchored sections into a final position as the building is being erected.

3. The method as claimed in claim 1, further comprising using sections having corrugations arranged in a direction perpendicular to the direction towards which the sections are bent during mounting, said corrugations being used as guides between a section during its mounting and earlier mounted sections situated above and at the sides of the section during mounting.

4. The method as claimed in claim 1, further comprising providing spacing members between the inner side of the sections and their associated transverse struts for preventing the anchoring members from unintentionally being disengaged from their associated struts.

5. The method as claimed in claim 4, comprising using separate triangular battens as said spacing members, said battens thereby being pushed in laterally between the mounted section and its associated strut from the interior of the building.

6. The method as claimed in claim 4, comprising providing each transverse frame member with an integral protruding flange acting as said spacing members.

* * * * *